United States Patent [19]

Wilks et al.

[11] Patent Number: 4,765,781

[45] Date of Patent: Aug. 23, 1988

[54] COAL SLURRY SYSTEM

[75] Inventors: David M. Wilks; Steven L. Mickna, both of Amarillo, Tex.

[73] Assignee: Southwestern Public Service Company, Amarillo, Tex.

[21] Appl. No.: 868,105

[22] Filed: May 29, 1986

Related U.S. Application Data

[62] Division of Ser. No. 710,302, Mar. 8, 1985, Pat. No. 4,602,483.

[51] Int. Cl.[4] ..... B65G 53/00

[52] U.S. Cl. ..... 406/197; 406/146; 62/55; 222/136

[58] Field of Search ..... 406/24, 25, 32, 120, 406/134, 136, 137, 146, 197; 62/48, 55; 137/208, 210; 366/137; 222/136, 129.2

[56] References Cited

U.S. PATENT DOCUMENTS

| | | | |
|---|---|---|---|
| 1,156,946 | 10/1915 | Vandercook | 366/137 |
| 3,933,001 | 1/1976 | Muska | 62/47 |
| 4,377,356 | 3/1983 | Santhanam | 406/197 X |

FOREIGN PATENT DOCUMENTS

| | | | |
|---|---|---|---|
| 31215 | 3/1978 | Japan | 406/136 |

*Primary Examiner*—Sherman D. Basinger
*Assistant Examiner*—Paul E. Salmon
*Attorney, Agent, or Firm*—Mason, Fenwick & Lawrence

[57] ABSTRACT

A slurry of liquified gas such as carbon dioxide and finely pulverized coal particles is provided in a mixing chamber and discharged from the chamber into a pipeline for conveyance to a power plant. During discharge from the mixing chamber pressurized gas at a sufficiently high pressure is injected above the slurry mix to maintain adequate pressure during discharge and prevent cavitation at the inlet port of a pump employed in the pipeline. The slurry is depressurized at the downstream end of the pipeline by movement through a pressure reducer so that it is decompressed non-adiabatically and the coal and gas particles are separated. The gas remains at a low temperature and is passed in heat exchange relationship with cooling water from the power plant cooling tower to lower the temperature of same and consequently increase the efficiency of the power plant. In another embodiment the gas comprises carbon dioxide and a portion of the cool carbon dioxide is discharged directly into the basin of the cooling tower to reduce the water temperature and provide beneficial cooling water chemistry control.

16 Claims, 6 Drawing Sheets

COAL SLURRY SYSTEM

This application is a division of application Ser. No. 710,302, filed Mar. 8, 1985 now issued as U.S. Pat. No. 4,602,483 dated July 29, 1986.

BACKGROUND OF THE INVENTION

The present invention is in the field of coal transportation and power plant utilization thereof and is specifically directed to unique methods and apparatus for conveying and feeding coal by a liquified gas/coal slurry pipeline to a power plant including unique power plant efficiency increasing methods and apparatus.

The vast majority of coal consumed at power plants in the United States is transported from the mine head to the power plants by rail or barge. Unfortunately, the cost of transportation by rail is quite substantial as a consequence of the inherent expense of rail transportation and the fact that individual railroads are frequently the only means by which coal can be transported from a particular mine. While barge transportation is generally more economical where available, many power plants and mines do not have access to waterways capable of enabling water transportation.

The foregoing and other problems have consequently resulted in a number of proposals for transporting coal in an liquid slurry pumped through a pipeline. A number of coal-water slurry pipelines have been built and commercially exploited in the United States with the longest pipeline of this type being in excess of 270 miles in length. However, coal-water slurry pipelines require both an adequate source of water conveniently located with respect to the mine and means for disposing of the transport water at the downstream end of the pipeline. Unfortunately, the foregoing circumstances are not always present, particularly in the West, and such pipelines are becoming les feasible with the passage of time.

The prior art has consequently come forth with a variety of proposals aimed at overcoming or reducing the shortcomings of present known coal transportation methods. For example, U.S. Pat. Nos. 4,173,530; 4,178,231; 4,178,233; and 4,265,737 disclose the concept of using fluorochlorocarbons as coal carriers in a slurry system. Bates U.S. Pat. No. 1,390,23 discloses the concept of a coal slurry in which the liquid carrier is oil or some other liquid hydrocarbon. Gruber, et al. U.S. Pat. No. 4,027,688 discloses a coal slurry in which pulverized coal is transported by a liquid hydrocarbon and methanol carrier mixture. Hamilton U.S. Pat. No. 1,385,447 discloses conveying coal through a pipeline by the use of a gas or fluid in which producer gas is a constituent of the carrier employed in the slurry. Keller U.S. Pat. No. 3,968,999 discloses the use of methanol or LPG as the slurry media. Wunsch, et al. U.S. Pat. No. 3,180,691 discloses the concept of providing a coal slurry in which the carrier media. comprises a liquified gas maintained at a sufficient pressure to remain in liquified condition until released at the end of the pipeline for expansion to permit the carrier gas to separate from the solid materials. British Pat. No. 2,027,446 discloses the conveyance of pulverized coal with a liquid fuel constituent.

Other prior United States patents have disclosed the use of liquified carbon dioxide as the carrier media of a coal slurry system. For example, Paull U.S. Pat. No. 3,976,443 discloses a slurry tank 17 in which pulverized coal is mixed with liquid carbon dioxide and pumped through a pipeline by a feed pump 24 through a heater 26 for discharge in a burner 30.

Similarly, Santhanam U.S. Pat. Nos. 4,206,610 and 4,377,356 also disclose the concept of conveying coal by the use of a liquid carbon dioxide slurry.

However, none of the prior art patents suggesting the use of liquified carbon dioxide as the carrier media for a coal slurry has been commercially exploited in so far as Applicants are aware. One possible reason for the non-exploitation of the Santhanam patents is the fact that the specification and claims of at least the '610 patent conflictingly indicate that th coal/liquid carbon dioxide slurry is adiabatically expanded and that prior to the adiabatic expansion, heat is introduced into the slurry to make up for the heat lost in the expanding to avoid solidification of the carbon dioxide. Since adiabatic expansion by definition does not involve heat loss, the aforementioned patent presents a basic inconsistency on its face.

Thus, while a variety of coal slurry pipeline systems have been suggested, they have not effectively presented facts resulting in widespread acceptance.

SUMMARY OF THE INVENTION

It is the primary object of the present invention to provide a new and improved coal slurry feeding and utilization system.

It is the further object of the present invention to provide a new and improved coal slurry feeding system which enhances the efficiency of a coal burning electric generating plant.

Achievement of the foregoing object is enabled in the preferred embodiments of the invention through the provision of accurate means for providing a liquified carbon dioxide or other liquified gas carrier media for pulverized coal in which the ratio of the coal to the carrier media and the consequent density of the slurry is carefully controlled for optimum flow efficiency. More specifically, a measured quantity of pulverized coal is mixed with a measured quantity of liquified carbon dioxide in a batch type operation providing a slurry of the required density. It should be understood that while the invention is described in connection with the use of liquified carbon dioxide as the carrier media, other liquified gases could be used instead of carbon dioxide. The slurry is provided in a pressurized chamber and is discharged from the lower end of the chamber at a predetermined pressure in excess of the pressure and temperature at which flashing of the liquified carbon dioxide would occur. Pressurized gaseous carbon dioxide at a higher temperature than that of the slurry is automatically introduced into the closed chamber above the slurry surface for maintaining pressure in the chamber at a required level above the critical pressure at which flashing could occur during the entire discharge of the batch of slurry from the chamber. Thus, during the discharge operation, there is no drop in pressure in the slurry which is fed into a pipeline connected to the suction inlet of a pump. The pressure is maintained at a sufficiently high level as to preclude flashing of the carbon dioxide at the inlet of the pump.

The pulverized coal/liquified carbon dioxide slurry is then pumped through a pipeline to a power plant in which it is discharged through pressure reducing nozzle means into a primary separator to reduce its pressure non-adiabatically and to flash most of the carbon dioxide into gaseous form. The carbon dioxide is separated from the solid materials by passage through a series of separator units comprising a primary separator, a secondary separator, a tertiary separator and a bag dust collector. The separated coal is metered and fed by a blower into burner units of a boiler of the power plant. The gaseous carbon dioxide resultant from the decompression of the liquified carbon dioxide is at a low temperature and may temporarily include some solid frozen particles.

The lower temperature gaseous carbon dioxide from the separators and bag dust collector is passed through a heat exchanger in which it absorbs heat from glycol being pumped in a closed loop through the heat exchanger and through the basin of the cooling tower of the power plant. The water in the cooling tower basin is consequently cooled by the gaseous carbon dioxide so as to consequently provide a resultant increase in the power plant efficiency. Alternatively, the low temperature carbon dioxide gas can be placed in heat exchange relation with the chilled water from the cooling tower flowing through a conduit to the steam condenser of the power plant. As a third alternative, a portion of the low temperature gaseous carbon dioxide can be injected directly into the cooling tower water to lower its temperature, decrease the pH to a desired level so as to prevent scaling and promote recarbonation following lime softening of cooling tower makeup water.

Additionally, the gaseous carbon dioxide from the heat exchanger (or remaining non-injected carbon dioxide in the case of the third option) can then be compressed and stored for sale or for further usage. One such type of further usage comprises injecting the gaseous carbon dioxide into an oil well for enhancing the recovery of petroleum products from the well. The gaseous carbon dioxide can optionally be returned to the mine source for re-liquification and subsequent use in the slurry pipeline if desired.

One particularly effective combination involves usage of carbon dioxide received from a well head near the coal mine, liquification and usage of the carbon dioxide as the slurry carrier media in a "one-way" pipeline to the power plant, usage of the gasified carbon dioxide in the power plant as discussed previously and reinjection of the gaseous carbon dioxide into an oil well. A system of the aforementioned type would be particularly efficient in terms of the power requirements of the "one-way" pipeline. Moreover, such a system would result in enhanced oil recovery from the particular well or wells into which the carbon dioxide is injected.

A better understanding of the various embodiments of the invention will be achieved when the following detailed description is considered in conjunction with the appended drawings in which the same reference numerals are used for the same parts as illustrated in the different drawing figures.

DESCRIPTION OF THE PREFERRED EMBODIMENTS

Figure 1A:
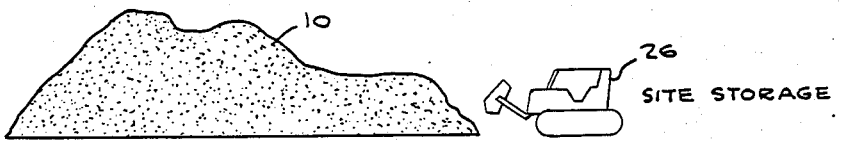
FIG. 1A is a process schematic of a slurry preparation portion of a first embodiment for practice of the invention.
Figure 1A:
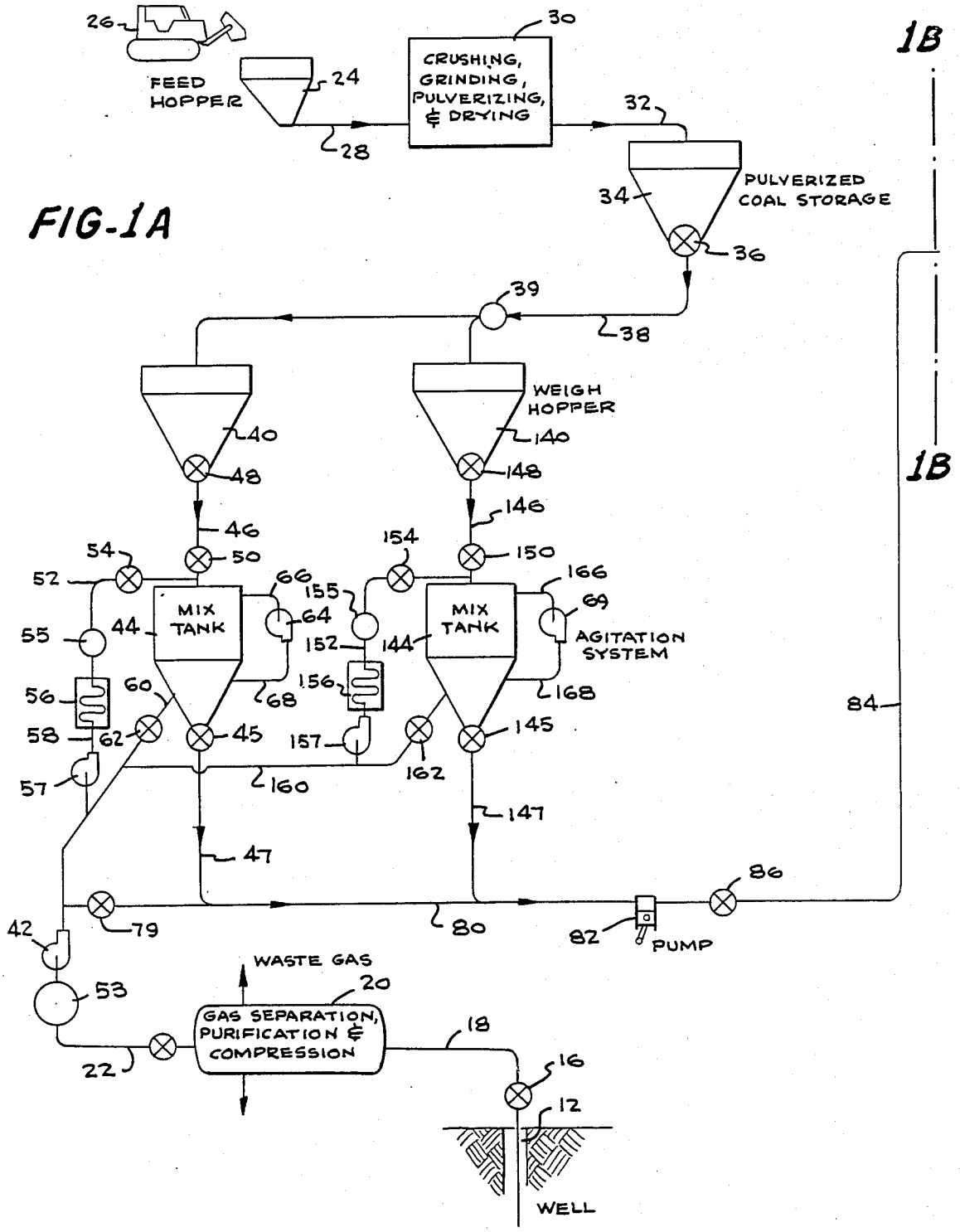
Figure 1B:
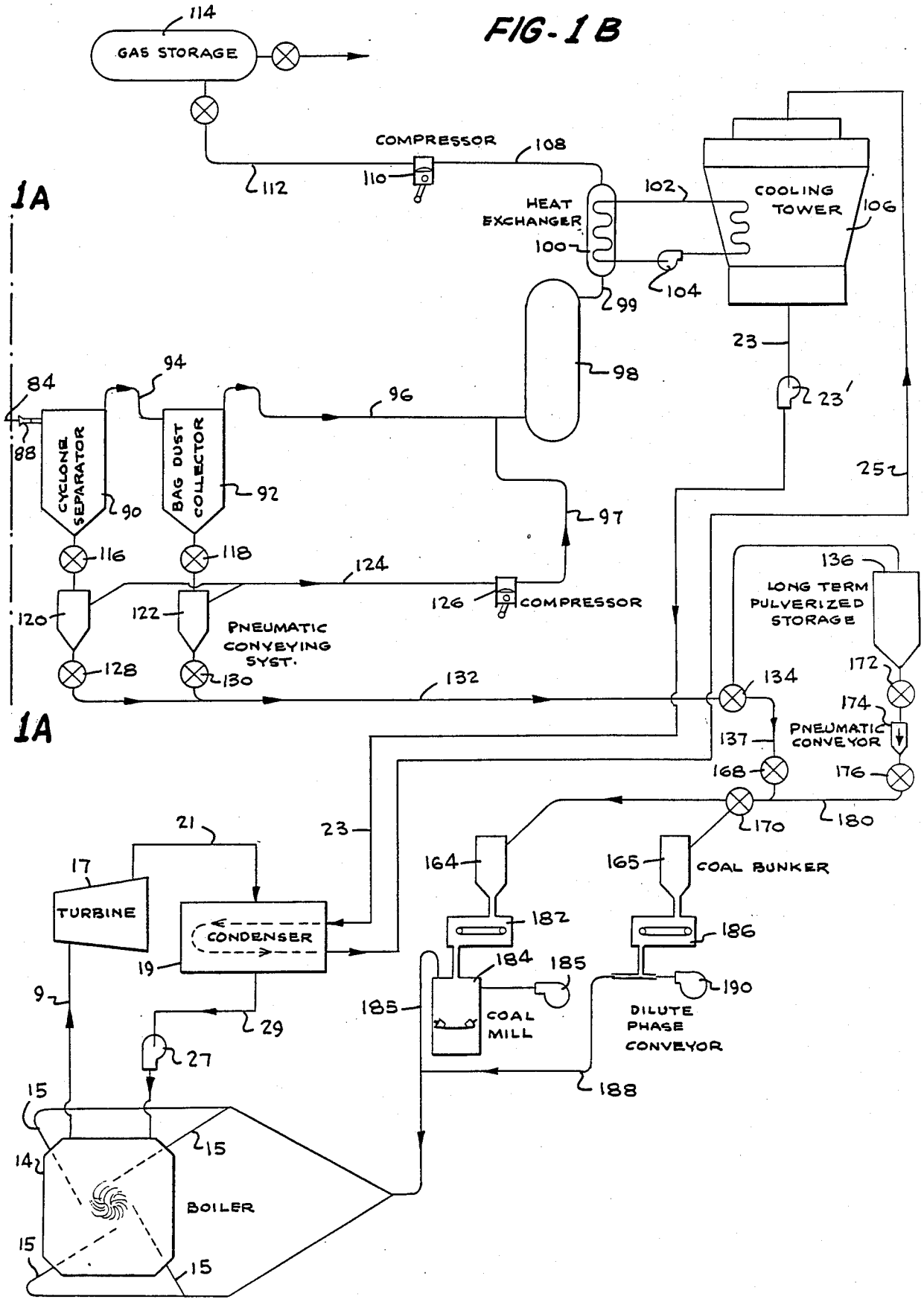
FIG. 1B is a process schematic of the remaining power plant portion of the FIG. 1A embodiment of the invention.

Attention is initially invited to FIGS. 1A and 1B for reference with respect to the following discussion of the first embodiment of the invention. The first embodiment includes three primary elements comprising a coal source such as a pile of coal 10, a gaseous carbon dioxide source such as a well 12 and a conventional coal burning boiler 14 of a steam turbine power plant. The primary elements are interconnected by various handling, storing and conveying devices for achieving a controlled input of pulverized coal into the boiler 14. In addition to boiler 14, the power plant includes a turbine 17 connected to boiler 14 by high pressure stream line 9 and to a condenser 19 by an exhaust steam line 21. A cooling tower 106 provides cooling water to condenser 19 by a chilled water line 23 including pump 23' an receives heated water from the condenser by warm water return line 25. Condensate from condenser 19 is returned to boiler 14 by feedwater pump 27 in feedwater line 29. The aforementioned relationship of the power plant components is completely conventional.

Gas such as carbon dioxide from well 12 flows through a well head valve 16 to a field transmission line 18 which conveys the well head gas to conventional gas separation, purification and compression means 20 which removes water and/or other undesirable contaminates from the gas. The major constituent of the gas is carbon dioxide; however, it should be understood that the well head gas can also include other gases such as methane, ethane, propane, nitrogen and hydrogen sulfide. The purified gas is compressed to a dense phase or liquid form and injected into a pipeline 22 which conveys it to liquified gas storage means 53. The liquified gas in storage means 53 is removed therefrom by supply pump 42 as required for conveyance to a slurry preparation plant for mixing with pulverized coal as illustrated in FIG. 1A.

The slurry preparation plant includes a main feed hopper 24 which receives coal from the main coal source 10 by means of front end loaders 26 or other conventional conveying and/or handling equipment. Coal from the hopper 24 is moved by conventional conveyor means 28 into crushing, grinding and pulverizing mill means 30 which provides pulverized coal which is moved by conveying means 32 into a pulverized coal storage hopper 34 of conventional design and which includes discharge control means 36 for discharging the pulverized coal into conveyor means 38 for selective delivery to either a first weigh hopper 40 or a second weigh hopper 140 or alternatively, simultaneous delivery to both hoppers. It should be understood that the pulverized coal conveyor 38 is of conventional construction and includes conventional control means 39 for directing the pulverized coal to either one or the other or both of hoppers 40 and 140. The pulverized coal conveyor means 38 will normally feed coal into one of the hoppers until a predetermined amount of coal is in the hopper at which time flow into that particular hopper will be terminated. The pulverized coal will then be conveyed into the other hopper to charge same while the pulverized coal in the first hopper is being mixed with liquid carbon dioxide to form a slurry and discharged in a manner to be discussed.

A first mix tank 44 has an upper inlet connected to an infeed conduit 46 which receives pulverized coal at atmospheric pressure flowing through a solids control valve 48 provided on the lower end of the first weigh hopper 40. A pressure isolation valve 50 is positioned in conduit 46 between the solids control valve 48 and the inlet to the mix tank 44. Additionally, a gas line 52 is connected through a gas flow control valve 54 to infeed conduit 46 at a point between valve 50 and the inlet to first mix tank 44. Gas line 52 receives gas from a heater 56 which in turn receives liquified gas supplied from a booster pump 57 in heater feed line 58 connected to pipeline 22. The liquified gas is converted into its gaseous phase by heater 56 as it passes through the heater from which it flows into a gas accumulator 55.

Pipeline 22 also connects to a first filling line 60 connected to the mix tank 44 and including a shut off valve 62. In like manner a second filling line 160 connects the pipeline 22 to the lower portion of a second mix tank 144 through a shut off valve 162. An agitator pump 64 has a suction line 66 connected to the upper portion of mix tank 44 and a discharge line 68 connected to the lower portion of mix tank 44 so that operation of pump 64 serves to stir the contents of mix tank 44 in an obvious manner. Alternate means of stirring (i.e., paddle mixer) could be used in mix tank 44 if desired.

Weigh hopper 140 has a solids control valve 148 for discharging pulverized coal into an infeed conduit 146 connected at its lower end to an inlet in the second mix tank 144. A pressure containing valve 150 is provided in the infeed conduit in the same manner as valve 50 is provided in the infeed conduit 46. A gas line 152 includes a gas accumulator 155 analogous to accumulator 55, a heater 156 analogous to heater 56, a booster pump 157, and a gas flow control valve 154 analogous to gas flow control valve 54. Agitation pump 164 has suction and discharge lines 166 and 168 connected to mix tank 144 for agitating the contents thereof here again, mechanical mixing means could also be employed if desired. Though gas accumulators, booster pumps and heaters are shown dedicated to a single mix tank, they could be combined to serve both mix tanks.

Discharge valves 45 and 145 are provided at the lower ends of mix tanks 44 and 144 respectfully for discharge of slurry by slurry discharge lines 47 and 147 respectively which discharge into a slurry pipeline 80 operating at pressures ranging between 850 and 1200 psig. Slurry pipeline 80 is connected to the inlet of a pipeline pump 82 having an outlet connected through a valve 86 to a transmission pipeline 84 which may be hundreds of miles in length (and include additional pumps).

In operation, the slurry preparation system illustrated in FIG. 1A discharges slurry first from mix tank 44 and then from mix tank 144 while the first mix tank 44 is being recharged. The slurry in mix tanks 44 and 144 will normally be at a pressure in the range of 900 to 1200 psig; however, pressures up to 1500 psig may be used if desired, such as when viscous slurry is involved.

A cycle of operation will be discussed with it being assumed that slurry is initially being discharged from the second mix tank 144 through line 147. Valves 150 and 162 are in a closed condition and valve 145 is an open condition. While the slurry is being discharged through valve 145 gaseous carbon dioxide is provided from heater 156 through gas accumulator 155, line 152 and gas flow control valve 154 to the upper portion of the interior of mix tank 144 in the space above the liquid in the mix tank. The gaseous carbon dioxide is supplied at a temperature exceeding 90° F. and at a pressure of at least 950 psig. The gas pressure should exceed the pressure in line 80 by at least 50 psig and the maximum gas pressure would be 1550 psig. The gaseous carbon dioxide introduced into the mix tank 144 by line 152 maintains pressure in the tank and in the slurry being discharged therefrom at a sufficiently high level in line 147 and slurry pipeline 80 up to the inlet of pump 82 to preclude flashing of any of the liquid carbon dioxide and subsequent undesirable thickening of the slurry. Gas flow control valves 54 and 154 are constant pressure type valves and automatically maintain the desired pressure downstream of themselves and in the upper extent of the mix tanks 44 and 144.

Valve 145 is closed prior to exhausting of the slurry from the mix tank 144 so as to preclude the entry of gas into the slurry discharge line 147. Termination of feed from the second mix tank 144 is also accompanied by closure of gas flow control valve 154 and the opening of valves 45 and 54 to initiate the feed of slurry to lines 47 and 80. Valves 45 and 54 are opened gradually prior to the closing of valves 154 and 145 to insure continuous flow of slurry to pipeline 80.

The manner in which the mix tanks 44 and 144 are charged with coal and liquid carbon dioxide will now be discussed with specific reference to mix tank 44; however, it should be understood that the charging of the second mix tank 144 is effected in an identical manner. The coal is crushed, ground, pulverized, dried and classified in conventional means 30 and is supplied to the pulverized coal storage hopper 34 from which it is fed by pulverized coal conveyor means 38 into the upper end of the first weigh hopper 40. After a predetermined charge of coal has been provided in the first weigh hopper 40, feed to hopper 40 is terminated and the coal is then directed by means 39 to the second weigh hopper 140 assuming the second weigh hopper is not full at that time. Valves 54, 62 and 45 are in a closed condition prior to the charging of the mix tank 44. Valves 48 and 50 are opened to permit a predetermined weight of pulverized coal from weigh hopper 40 to consequently flow into the mix tank 44. Valves 48 and 50 are then closed and liquid valve 62 is opened to permit liquid carbon dioxide to flow into the mix tank 44 to achieve a slurry having a specific desired density. The density of the slurry can be varied by varying the weight of coal which is provided in the mix tank while always substantially filling the remaining volume of the mix tank with liquid carbon dioxide. It will therefore be apparent that changing the amount of coal will automatically effect a change in the slurry density.

Circulating pump 64 is actuated so as to achieve and maintain a uniform slurry density throughout the tank. The slurry in the mix tank 44 is consequently in condition for ready discharge into line 47 and the slurry pipeline 80. Discharge of slurry into the pipeline is effected by opening of valve 45 and a similar simultaneous opening of valve 54 which permits the injection of gaseous carbon dioxide at a temperature greater than 90° F. and a pressure of approximately 950 psi above the liquid level in the mix tank 44. The injection of the gaseous carbon dioxide is controlled by the constant pressure of valve 54 so that the pressure in the tank does not decrease as the slurry is discharged outwardly through the valve means 45. Sufficient pressure is consequently maintained in the tank and in the slurry pipeline 80 to prevent any flashing of the liquid carbon dioxide at the suction inlet of pipeline pump 82.

It will be appreciated that the weigh hopper 40 can be receiving pulverized coal at the same time that the mix tank 44 is discharging liquid carbon dioxide/coal slurry into the slurry pipeline 80. Since the valves 48 and 50 are closed, there is no possibility of the pulverized coal flowing into the mix tank 44 during the same time that the slurry is being discharged from the lower end of the mix tank. Valve 45 is closed shortly prior to the time that the slurry would exhaust form the mix tank 44 so as to preclude the injection of gas into the slurry discharge line 47. Similarly, valve 54 is also closed to terminate the supply of gaseous carbon dioxide to mix tank 44.

In case of a malfunction of either or both of the mix tanks, valve 79 can be opened to maintain suction pressure at the pump inlet of pump 82 to protect the pump from cavitation. Similarly, valve 79 can also be opened to bypass the mixing vessels 44 and 144 when it is desired to clear the pipelines 80, 84 of slurry by the flushing of same with the liquified carbon dioxide.

FIG. 1B illustrates the downstream end of the slurry transmission pipeline 84 which discharges into a power plant facility in which the pulverized coal from the slurry is burned in boiler 14. It should be understood that the slurry transmission pipeline can be of any desired length and can include plural pumps along its length as needed for maintaining pressure and flow. In any event, the slurry transmission pipeline 84 normally operates at a minimum pressure of 900 to 950 psig and at ambient earth temperature of approximately 70° F. Pipeline 84 discharges into a pressure reduction restriction, or series of restrictions or nozzles 88 discharging into cyclone separator 90 in which the temperature will be in the range of 0° through 25° F. with the pressure being in the range of 300 to 450 psig. The slurry upstream of the pressure reduction means 88 is at a pressure above the liquid-gas saturation point and the pressure is reduced in a non-adiabatic manner below the liquid-gas saturation point as the slurry moves through the pressure reduction means 88. Consequently, a substantial portion of the liquified gas is transformed from the liquid state to the gaseous state and a portion may be in solid state for a a short time duration. Moreover, any residual liquified gas that is not transformed into gas by the pressure reduction or solidified gas that is formed during the pressure reduction will absorb latent heat from the coal and be converted to gas in a relatively rapid manner. Also, any carbon dioxide that is solidified as a consequence of the pressure reduction will quickly be converted to gaseous form by the absorption of heat from the coal.

Separation of the gas from the coal is effected by cyclone separator 90 from which the pulverized coal is discharged downwardly for further handling in a manner to be discussed later. The gas and any entrapped fine coal particles therein from the cyclone separator 90 flow through a gas line 94 into a bag dust collector 92 which separates the remaining coal particles from the cold gas (0° to 25° F.) which is then conveyed by a line 96 to conventional filter dehydrator means 98 from which dehydrat the gas then flows in line 99 through a heat exchanger 100 where the gas is placed in heat exchange relationship with a glycol loop 102 in which glycol is circulated by a pump 104. Glycol loop 102 also communicates in a heat exchange relationship with the circulating water in a cooling tower 106. Since the temperature of the gas passing through the heat exchanger 100 is substantially less than the temperature in the cooling tower, the gas cools the glycol in glycol loop 102 which in turn cools the water in the cooling tower 106. Liquids other than glycol having a freezing temperature lower than 0° F. can also be employed if desired.

The chilled cooling tower water from cooling tower 106 is circulated through condenser 19 by circulating pump 23' and lines 23 and 25 and is used for condensing the steam in condenser 19. The reduction in temperature effected by the additional cooling of the cooling tower water by glycol loop 102 consequently permits the pumping of a reduced amount of water to the condenser or the same amount at a lower temperature so as to provide an increase in overall efficiency of the power plant.

The gas from heat exchanger 100 is at a temperature in the range of 60° to 90° F. and is discharged into a line 108 communicating with the inlet of a compressor 110 which compresses the gas and discharges it into a line 112 communicating with gas storage means 114 from which the gas can eventually be discharged for use in a variety of ways. For example, if the gas is carbon dioxide, it could be used for reinjection into an oil field to enhance the oil recovery. On the other hand, if the gas is combustible, it could be sold or used as a fuel.

The pulverized coal particles separated from the gas in the cyclone separator 90 and the bag dust collector 92 pass through valve means 116, 118 into dense phase conveyor transporter housing members 120, 122 respectively which basically comprise closed hoppers. Residual gas from the transporter housing members 120 and 122 flows into a line 124 communicating with the inlet of a compressor 126 which compresses the gas and injects it into line 97 connected to line 96. Operation of compressor 126 also lowers the pressure in members 120 and 122 to the range of 35 to 70 psig before valve means 128, 130 are operated to dump the pulverized coal into pneumatic conveyor 132.

The pulverized coal from the dense phase conveyor transporter housing members 120 and 122 passes through flow control valve means 128 and 130 respectively into a pneumatic conveyor 132 which communicates on its downstream end with flow control valve means 134 which is operable for directing the coal to either a long term pulverized storage facility 136 or a feed line 137 which communicates with means for directing the coal to boiler 14.

First and second short term coal storage bunkers 164 and 165 are provided for receiving the pulverized coal from feed line 137 through valve 168 and bunker select valve 170. The long term storage facility 136 discharges through a valve flow control 172 into a pneumatic conveyor 174 which communicates through a valve 176 to a line 180 connected to bunker select control valve 170. All coal storage facilities and bunkers have a nitrogen or other inert gas blanketing system (not shown) for protection against spontaneous combustion of the pulverized coal. The pulverized coal is fed to one or the other of the bunkers 164, 165 at any given time and coal flowing from the first bunker 164 will enter scale means 182 from which it flows into a mill 184 which grinds the coal to a desired size for injection into the boiler. Fan 185 is connected to mill 184 for conveying the coal therefrom pneumatically to line 155 for flow to boiler 14.

Alternatively, the pulverized coal can be fed from bunker 165 into a scale 186 from which it flows directly (without further pulverization) into a pneumatic fuel conveyor 188 driven by a blower 190. In any event, the pulverized coal in pneumatic fuel conveyor 188 is conveyed directly to fuel injectors 15 for combustion in boiler 14.

It should be understood that the simplified arrangement illustrated in FIGS. 1B and 1A can be modified substantially for different size installations. For example, additional cyclone separators 90 and bag dust collectors 92 and mixing vessels could be employed for larger installations. Also, plural storage facilities 136, coal bunkers 164 and 165 could also be employed if needed.

Figure 4:
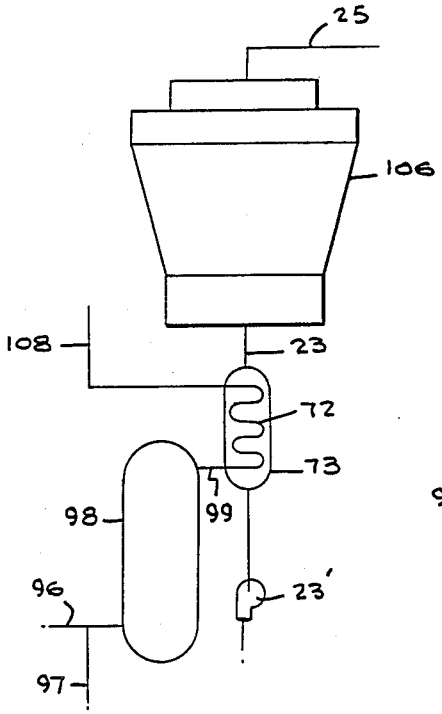
FIG. 4 is a flow schematic of alternative heat exchange means employabl with either the first or second embodiment.

FIG. 4 illustrates an alternative heat exchange embodiment in which the chilled gas from filter dehydrator 98 flows directly through a coil 72 in a heat exchanger housing 73 mounted in the chilled water pipeline 23 so that the water is directly cooled in the pipeline. The gas then flows into line 108 in the same manner as in the first embodiment.

Figure 5:
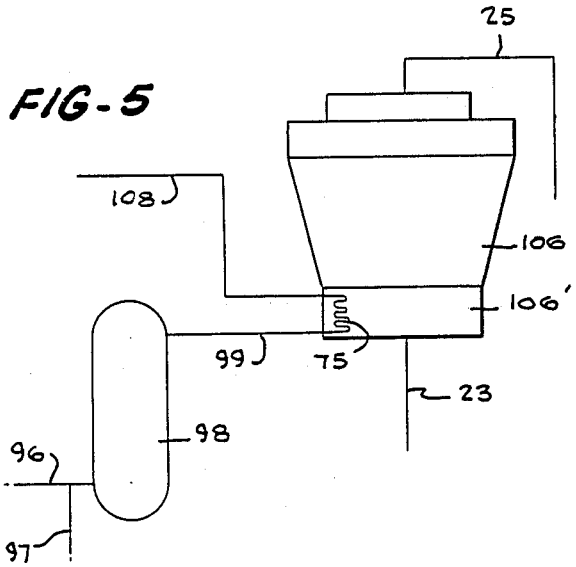
FIG. 5 is a flow schematic of a further alternative heat exchange means employable with either the first or second embodiments.

FIG. 5 illustrates a second heat exchange embodiment in which the chilled gas from the filter dehydrator 98 flows through a heat exchange coil 75 provided in the cooling tower basin 106' below the water level so that the water in the basin is directly cooled by the chilled gas which is then conveyed to line 108 which is connected to the downstream equipment as illustrated in the first embodiment.

Figure 6:
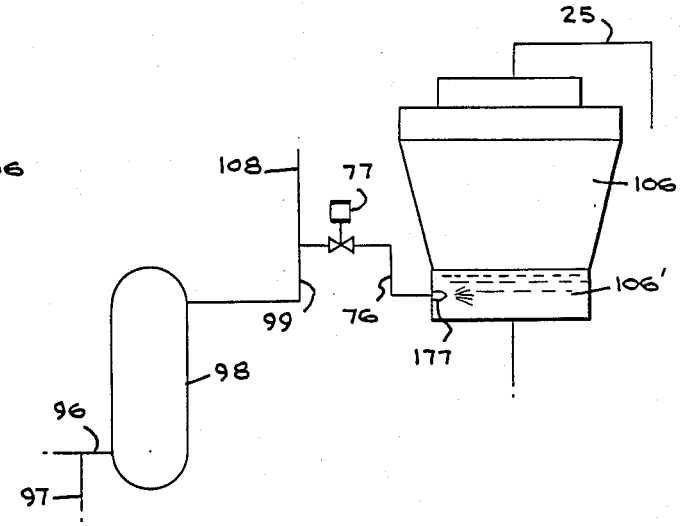
FIG. 6 is a flow schematic of yet another alternative hea exchange means employable with either the first or second embodiment of the invention.

FIG. 6 illustrates a third heat exchange embodiment in which lines 99 and 108 are directly connected and a branch line 76 including a control valve 77 extends therefrom. Line 76 has a nozzle means 177 at its outer end for directly injecting the chilled carbon dioxide gas into the basin 106' of the cooling tower 106 to consequently cool the water therein. Moreover, the injection of the gaseous carbon dioxide serves to decrease the pH of the water to reduce the possibility of scaling in the tower in a highly desirable manner and to promote recarbonation following lime softening of cooling tower makeup water. The amount of carbon dioxide injected directly into the basin is controlled by valve means 77 in an obvious manner. The remaining gaseous carbon dioxide flows through line 108 to compressor 110 etc. of the first embodiment.

Figure 2A:
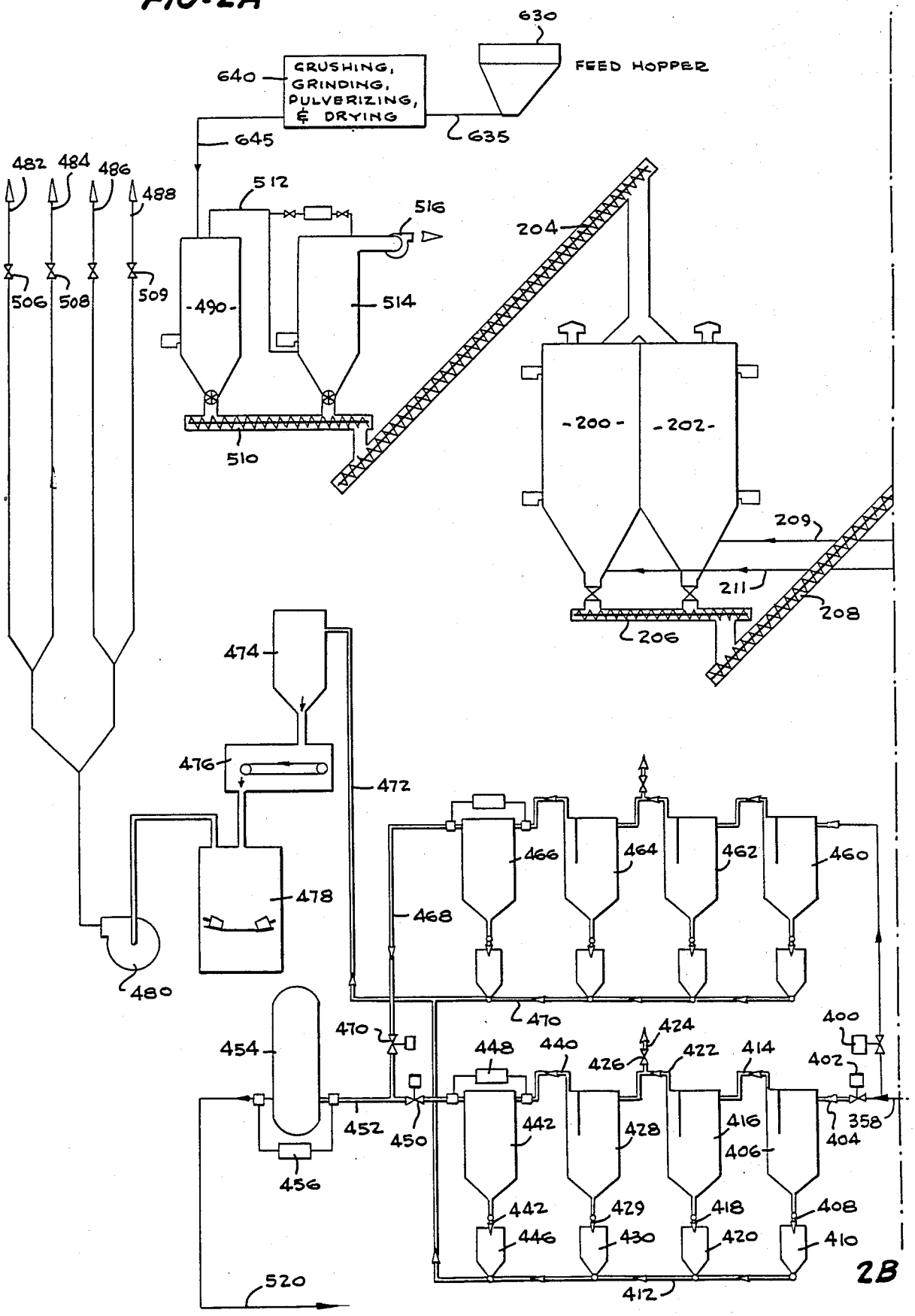
FIG. 2A is a process schematic of a portion of a second embodiment for practice of the invention.
Figure 2B:
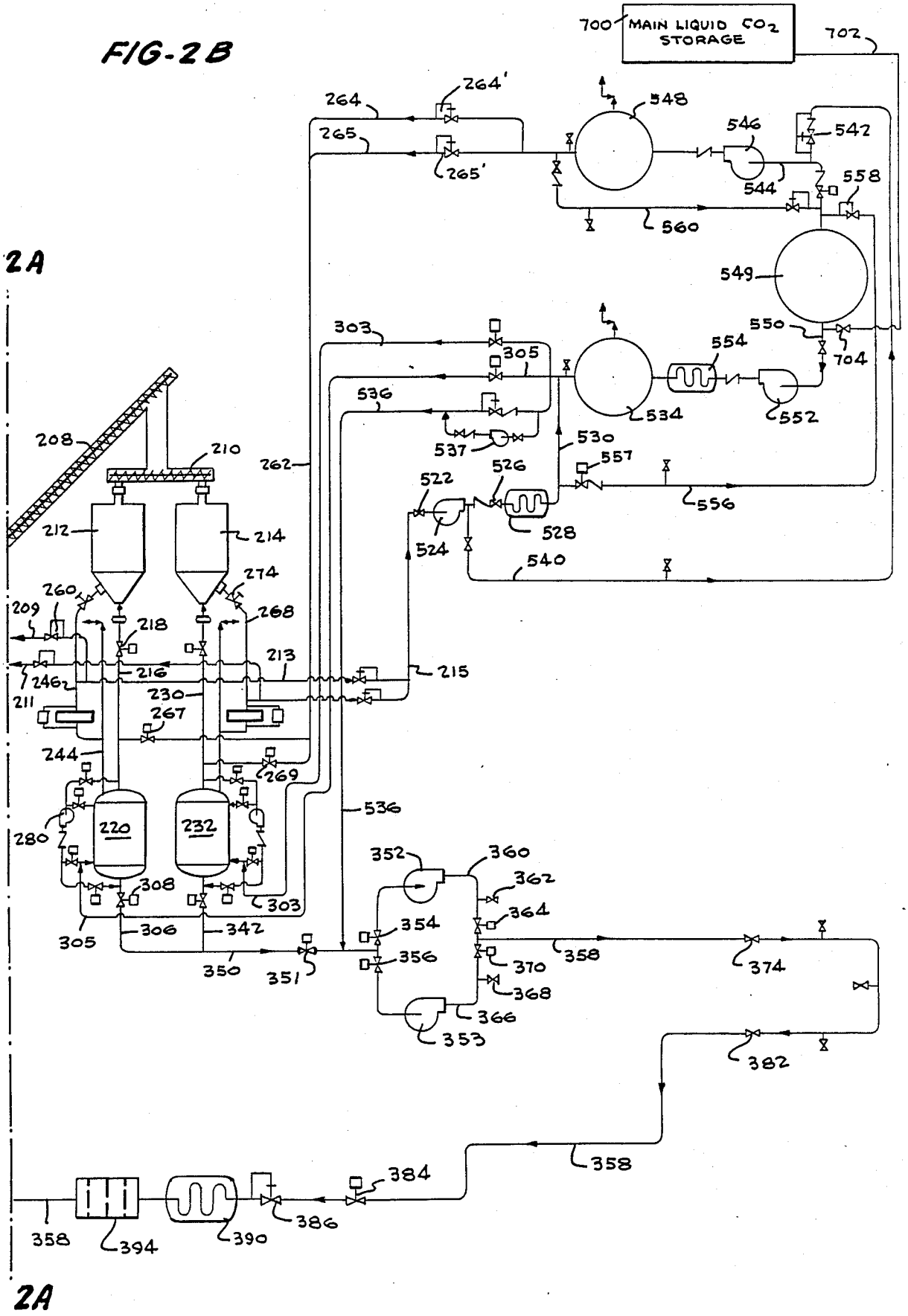
FIG. 2B is a process schematic of the remaining portion of the second embodiment.

The embodiment illustrated in FIGS. 2A and 2B is a more complex variation such as could be used for testing purposes. This embodiment will now be discussed in detail with initial reference being made to FIG. 2A which illustrates first and second relatively large pulverized coal storage hoppers 200 and 202 which selectively receive pulverized coal from a screw conveyor 204. Pressurized gas lines 209 and 211 are periodically activated to inject pressurized gas at approximately 50 psig into the coal storage hoppers 200 and 202 for the purpose of stirring the pulverized coal and preventing settling and to also maintain an inert gas blanket over the pulverized coal as a safety feature. Pulverized coal is selectively fed from the coal storage hoppers 200 and 202 by outfeed conveyor 206 from which it is deposited in a hopper feed conveyor 208 which discharges into a reversible screw conveyor 210 which discharges into either a first feed hopper 212 or a second feed hopper 214 (FIG. 2B) in accordance with the direction in which the screw of conveyor 210 is driven.

Figure 3:
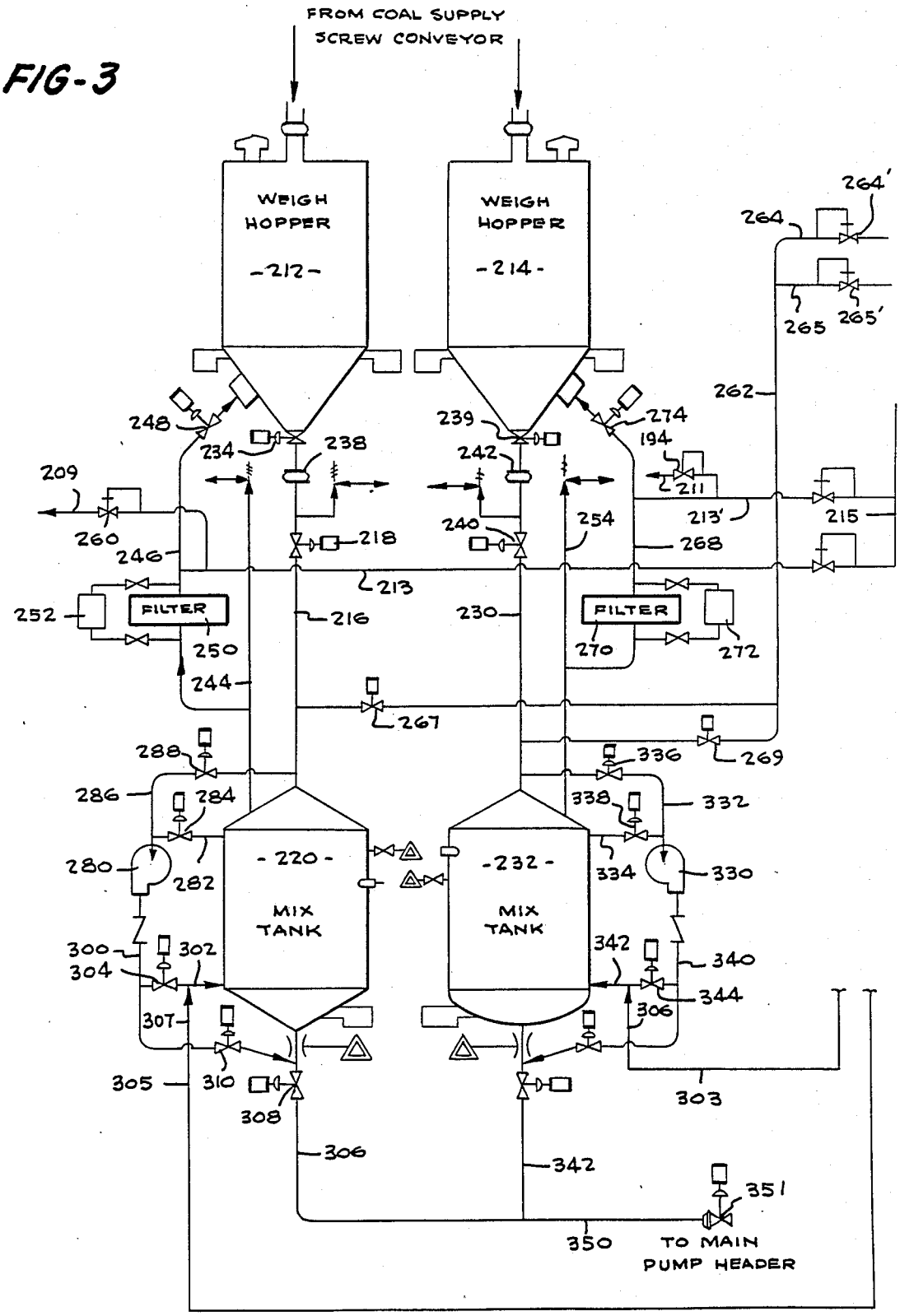
FIG. 3 is an enlarged flow schematic of a coal and carbon dioxide mixing system employed in the second embodiment.

Weigh hopper 212 discharges into a coal feed line 216 which includes a solids flow control valves 218 and 234 as best illustrated in FIG. 3. Valve 234 and a corresponding valve 239 on hopper 214 are not illustrated in FIG. 2B due to space limitations. The lower end of coal feed line 216 communicates with the interior of a first mix tank 220. A second coal feed line 230 communicates the second weigh hopper 214 with a second mix tank 232. Lines 216 and 230 are connected to source 264 line of relatively low pressure carbon dioxide gas and a source 265 of relatively high pressure carbon dioxide gas through line 262 and pneumatic control valves 267 and 269 respectively. A pressure regulator 264' (FIG. 2B) maintains a pressure of approximately 300 psia in line 264 whereas a pressure regulator 265' maintains a pressure of approximately 900 psia in line 265. Regulator 264' is initially operated to pressurize either mixing tank 220 or 232 up to 300 psig following which regulator 265' is operated to bring the mixing tank up to 900 psig. The two stage pressurization prevents the formation of solid carbon dioxide in the tanks by avoiding excessive pressure drops.

Control valves 234 and 218 are provided in coal feed line 216 along with and on opposite sides of an expansion joint 238. Similar control valves 239 and 240 are provided on opposite sides of an expansion joint 242 in the second coal feed line 230.

A gas line 244 having a pressure relief valve at its upper end extends upwardly from the upper end of mix tank 220 and is connected to a second gas line 246 connected through a valve 248 to the lower end of weigh hopper 212. Filter means 250 is provided in gas line 246 and has a pressure differential sensor 252 is connected across the filter means. Gas line 246 is connected to gas line 209 extending from the coal storage hopper 202 by means of a through connection to line 213. Pressure regulator 260 is provided in line 209 and is set to open when the upstream pressure falls below 50 psig.

Gas line 254 similarly extends upwardly from mix tank 232 and is connected to a gas line 268 analogous to line 246 and having filter means 270 and associated pressure differential means 272 mounted therein. A valve 274 is mounted in the upper end of gas line 268 adjacent a connection to the lower end of weigh hopper 214. Line 211 extending from hopper 200 is connected through pressure regulator 194 to line 213' which is connected to gas line 268. Pressure regulator 194 opens when its upstream pressure falls below 50 psig. Lines 213 and 213' are connected to suction line 215 extending from the inlet of a compressor 524 (FIG. 2B).

A circulating pump 280 is associated with the first mix tank 220 and has its inlet connected to a line 282 through valve 284 to the upper end of mix tank 220. Additionally, a further line 286 connects the inlet of circulating pump 280 to the coal feed line 216 through a valve 288. The outlet of circulating pump 280 is connected to a line 300 which is in turn connected to a line 302 which communicates with the lower portion of mix tank 220 through a valve 304. A source line 305 of liquified gas is connected to line 302 by line 307. Additionally, line 300 communicates through valve 310 with a slurry discharge line 306 extending from the lower end of mix tank 220 and having a valve 308 beneath its junction with line 300.

Similarly, a circulating pump 330 is provided with the second mix tank 232 and has its inlet connected to lines 332, 334 which respectively include valves 336 and 338. The outlet of circulating pump 330 is connected to a line 340 which is in turn connected through valve 344 to a slurry discharge line 342 extending from the bottom of mix tank 232. Line 342 is connected through line 306 to a liquified gas source line 303.

First and second slurry pumps 352 and 353 have their inlets connected to the main infeed line 350 (which receives slurry from lines 306 and 342) through valves 354 and 356 and have their outlets connected to a high pressure slurry feed line 358 with the outlet of pump 352 comprising a line 360 in which valves 362 and 364 are provided. Similarly, the outlet of pump 353 comprises a line 366 in which valves 368 and 370 are provided. High pressure slurry feed line 358 flows through a series of valves 374, 382, 384, and 386 to the inlet of heater 390. Orifice plate pressure drop means 394 is provided immediately downstream of heater 390 to receive dense phase slurry at approximately 140° F. and acts to drop the pressure thereof to approximately 900 psia.

The main slurry feed line 358 is connected to motor operator control valves 400 and 402 (FIG. 2A) which respectively control flow to first and second banks of gas/solids separator units to be discussed. Flow through the valve 402 is directed through a restricting nozzle 404 which effects a non-adiabatic pressure drop to approximately 300 psig and from which the discharge is directed into a primary separator 406 which separates a substantial portion of the coal from the carrier gas with the coal being directed downwardly through an isolation valve 408 to a dense phase conveyor feed 410 from which it enters pneumatic conveyor line 412. A line 414 connects the upper portion of the primary separator 406 to the inlet of a secondary separator 416 having an isolation valve 418 and a dense phase conveyor feed 420 connected to its lower end. Coal particles separated from the gas flow into dense phase conveyor feed 420 and pneumatic conveyor line 412 in the same manner as occurs with the primary separator 406. A line 422 includes an atmospheric vent line 424 and pressure relief valve 426 and is joined to a tertiary separator 428 having isolation valve 429 connected to a dense phase conveyor feed 430 which is connected to the pneumatic conveyor feed line 412 in the same manner as previously discussed separators 406 and 416. An outlet line 440 from the tertiary separator 428 is connected to the inlet of a bag dust collector 442 which has an isolation valve 444 and dense phase conveyor feed 446 at its lower end connected to the pneumatic conveyor 412. A pressure differential sensor 448 is provided across the inlet and outlet of the bag dust collector 442. Gas from the bag dust collector 442 flows through a control valve 450 in gas line 452 into the inlet of a filter/dehydrator unit 454 across which a pressure differential sensor 456 is provided. Gas from the filter/dehydrator unit 454 goes into line 520 to be stored, recycled, sold or otherwise disposed of such as through oil field well injection. The gas in line 520 is chilled and can be used for cooling the condenser cooling water of the power plant in the manner illustrated in any of FIGS. 1B, 4 or 5. Following such use, the gas can be recycled or used as needed for other purposes.

The second bank of separator units receives slurry from a restricting nozzle 404' identical to nozzle 404 and consists of a primary separator 460, a second separator 462, a tertiary separator 464 and a bag dust collector 466 in which the arrangement is exactly identical to the arrangement of the separator 406, etc. of the first bank of units. A gas outlet line 468 flows through a control valve 470 into the gas infeed line 452 of the filter/dehydrator 454. Similarly, a pneumatic conveyor line 470 receives coal particles from the separator units 460, 462, 464 and the bag dust collector 466 and joins with the pneumatic line 412 to form a coal feed line 472 connected to the upper end of a scale feed bunker 474. The structure and operation of the second bank of separator units is identical to the first bank of separator units.

Scale feed bunker 474 feeds the pulverized coal into a conventional belt scale 476 which is modified for handling pulverized material. The belt scale monitors the coal flow and which in turn feeds the coal into a mill 478 for reducing the particle size. The reduced coal particles from mill 478 and carrier gas therefore are fed by a blower 480 to boiler feed lines 482, 484, 486, and 488 to provide combustion coal for the boiler through flow control valves 506, 508 and 509 respectively.

Coal for use in the system is prepared as best illustrated in FIG. 2-A by the use of feed hopper means 630 connected by a conduit 635 to crushing, grinding, pulverizing and drying means 640 analogous to elements 24, 30 of the first embodiment. A discharge line 645 extends from the outlet of the crushing, grinding, pulverizing and drying means to the inlet of cyclone separator 490.

Gas from the upper end of the cyclone separator 490 flows through a line 512 into a bag house 514 which provides further coal/gas separation with the coal being discharged into the auger conveyor 510 and the gas being discharged outwardly by blower means 516.

The gas discharge from compressor 524 is at a pressure of approximately 1200 psig and flows through a valve 526 into a heat exchanger 528 which reduces the temperature of the gas from 260° F. to 70° Fahrenheit and which discharges the now liquified gas into line 530 which is connected to liquid gas source line 305 extending to line 307 and mix tank 220 as previously described. Line 530 is also connected to gas accumulator 534 which stores liquified gas at 1200 psig and 70° F. Similarly, line 303 provides similar communication to mix tank 232 and further line 536 extends from line 305 to a juncture with line 350 downstream of valve 351 as shown in FIG. 2B. A pipeline pressure booster pump 537 is provided in association with line 536 for maintaining adequate pressure therein during a pumping operation through line 536.

A line 540 is also connected to the output from compressor 524 to provide gaseous flow through valve 542 into an inlet line 544 of compressor 546 which discharges into gas accumulator 548 which stores gas at a pressure in the range of 1300 to 1500 psig and temperatures in the range of 320° to 350° F. A liquified gas storage tank 549 has an upper outlet connected to line 544 and a lower outlet connected to line 550 which is in turn connected through a valve 551 to the inlet of a liquid pump 552 which discharges into a heat exchanger 554 which discharges into liquid accumulator 534. A main liquid carbon dioxide storage tank 700 is connected to line 550 by line 702 flowing through valve 704. Line 556 provides communication between line 530 and line 544 through valves 557 and 558 a further line 560 provides bypass communication between line 265 and line 544.

We claim:

1. A method of providing a liquified gas coal slurry in a pipeline comprising the steps of:
(a) providing a predetermined weight of pulverized coal into a chamber closed to a slurry receiving means;
(b) providing liquified gas in the closed chamber so as to substantially fill the closed chamber with slurry at a predetermined pressure and temperature;
(c) placing said chamber in communication with said slurry receiving means; and
(d) discharging slurry from the lower end of said closed chamber into said slurry receiving means that is at a pressure substantially less than said predetermined pressure while simultaneously injecting a pressure maintaining gas at a temperature slightly above said predetermined temperature and at a pressure that is substantially greater than the pressure in said receiving means into the upper extent of said chamber above the slurry so as to maintain said slurry at a sufficiently high pressure as to prevent flashing of the liquid to vapor during the slurry discharge.

2. The method of claim 1 wherein the liquified gas and said pressure maintaining gas are of the same chemical composition.

3. The method of claim 1 wherein said liquified gas is carbon dioxide.

4. The method of claim 3 wherein said pressure maintaining is carbon dioxide.

5. The method of claim 1 wherein said pressure maintaining gas is injected into the upper extent of said closed chamber at a pressure which exceeds the pressure in the receiving means by a least 50 psig.

6. The method of claim 5 wherein the liquified gas and said pressure maintaining gas are of the same chemical composition.

7. The method of claim 6 wherein said liquified gas is carbon dioxide.

8. The method of claim 7 wherein said pressure maintaining gas is carbon dioxide.

9. The method of claim 1 wherein said pressure maintaining gas is provided by passing liquified gas through a heater.

10. The method of claim 9 wherein said pressure maintaining gas is injected into the upper extent of said chamber at a pressure which exceeds the pressure in the receiving means by at least 50 psig.

11. The method of claim 10 wherein the liquified gas and said pressure maintaining gas are of the same chemical composition.

12. The method of claim 11 wherein said liquified gas is carbon dioxide.

13. The method of claim 12 wherein said pressure maintaining gas is carbon dioxide.

14. The method of claim 1 wherein the pressure maintaining gas is injected into said closed chamber after said closed chamber is charged with the liquified gas coal slurry.

15. The method of claim 1 including the additional steps of:
(a) terminating the discharging of said slurry from said chamber while there is still a small quantity of slurry in said closed chamber;
(b) again providing a predetermined weight of pulverized coal into said closed chamber;
(c) again providing a liquified gas in the closed chamber so as to substantially fill the closed chamber with a slurry at a predetermined pressure and temperature; and
(d) again discharging slurry from the lower end of said closed chamber while simultaneously injecting a pressure maintaining gas at a pressure and temperature slightly above said predetermined pressure and temperature into the upper extent of said chamber above said slurry so as to maintain said slurry at a sufficiently high pressure as to prevent flashing of the liquid to vapor during the slurry discharge.

16. The method of claim 1 wherein there is substantially no drop in pressure in said slurry upon discharge from said closed chamber.

* * * * *